US010180023B2

(12) United States Patent
Zasowski et al.

(10) Patent No.: US 10,180,023 B2
(45) Date of Patent: Jan. 15, 2019

(54) APPARATUS AND METHOD FOR CONTROL OF SPRING FORCE IN A DOOR CLOSER OR OPERATOR

(71) Applicant: Yale Security, Inc., Monroe, NC (US)

(72) Inventors: Peter Zasowski, Yantis, TX (US); Dustin Lawhon, Lilesville, NC (US)

(73) Assignee: ASSA ABLOY Accessories and Door Controls Group, Inc., New Haven, CT (US)

( * ) Notice: Subject to any disclaimer, the term of this patent is extended or adjusted under 35 U.S.C. 154(b) by 172 days.

(21) Appl. No.: 15/280,014

(22) Filed: Sep. 29, 2016

(65) Prior Publication Data

US 2017/0096848 A1 Apr. 6, 2017

Related U.S. Application Data

(60) Provisional application No. 62/237,724, filed on Oct. 6, 2015.

(51) Int. Cl.
*E05F 1/10* (2006.01)
*E05F 3/10* (2006.01)

(52) U.S. Cl.
CPC ..... *E05F 1/105* (2013.01); *E05F 3/10* (2013.01); *E05F 3/102* (2013.01); (Continued)

(58) Field of Classification Search
CPC .. E05F 1/105; E05F 3/10; E05F 3/102; E05Y 2201/41; E05Y 2201/492; E05Y 2900/132; Y10T 16/285; Y10T 16/293
See application file for complete search history.

(56) References Cited

U.S. PATENT DOCUMENTS 2,414,894 A * 1/1947 Pfent ..... E05F 1/105 16/80
4,686,739 A 8/1987 Fritsche et al.
(Continued)

FOREIGN PATENT DOCUMENTS

GB 1272405 A * 4/1972
GB 2180294 A 3/1987
GB 2239290 B 6/1993

*Primary Examiner* — Victor D Batson
*Assistant Examiner* — Matthew J Sullivan
(74) *Attorney, Agent, or Firm* — DeLio, Peterson & Curcio, LLC; David R. Pegnataro

(57) ABSTRACT

An apparatus for adjusting the force in a door operator or closer comprises an elongated housing and a spring therein connected to the door operator or closer. A spring collar is non-rotatable about the longitudinal axis of the housing and adapted to move linearly within the housing. A fixed adjusting screw extends along a longitudinal axis of the housing and the spring collar is slidable linearly along an outer surface of the adjusting screw. A nut is threadably engaged at a distal end of the adjusting screw and is rotatable about the longitudinal axis of the screw, the nut bearing on the spring collar during rotation. The spring collar bears on a distal end of the spring to vary the spring compression and thereby vary force applied by the door operator or closer. The housing has an opening in a sidewall through which the spring is visible, and the housing exterior surface includes markings indicating the degree of spring compression. An indicator is moveable along and visible from the exterior of the housing to indicate the compression of the spring.

21 Claims, 6 Drawing Sheets

(52) U.S. Cl.
CPC ..... *E05Y 2201/41* (2013.01); *E05Y 2201/492* (2013.01); *E05Y 2900/132* (2013.01)

(56) References Cited

U.S. PATENT DOCUMENTS

| | | | | |
|---|---|---|---|---|
| 4,783,882 | A | 11/1988 | Frolov | |
| 5,265,306 | A * | 11/1993 | Yu | E05F 3/10 16/51 |
| 5,802,670 | A | 9/1998 | Bienek | |
| 6,282,750 | B1 | 9/2001 | Bishop et al. | |
| 6,711,856 | B1 * | 3/2004 | Hoffman | E05F 1/105 296/207 |
| 7,025,343 | B2 | 4/2006 | Chou | |
| 8,732,905 | B2 * | 5/2014 | Bell | E05F 3/102 16/71 |
| 9,631,411 | B2 * | 4/2017 | Lutz | E05D 11/1064 |
| 9,695,620 | B2 * | 7/2017 | Zasowski | E05F 1/105 |
| 9,903,145 | B2 * | 2/2018 | Huber | E05F 1/1058 |
| 2015/0176319 | A1 * | 6/2015 | Huang | E05F 1/105 16/80 |
| 2016/0265619 | A1 * | 9/2016 | Kull | E05C 17/30 |

* cited by examiner

FIG. 4
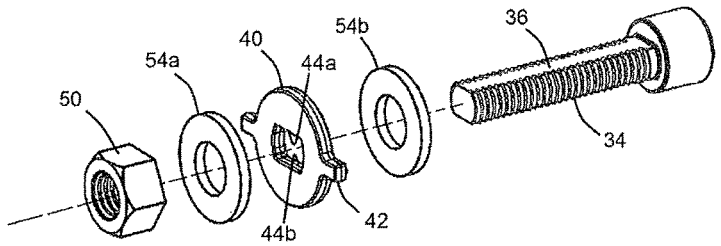
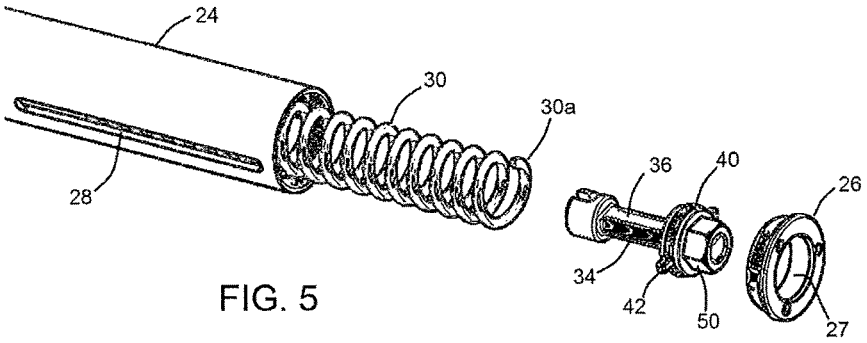
FIG. 5

APPARATUS AND METHOD FOR CONTROL OF SPRING FORCE IN A DOOR CLOSER OR OPERATOR

RELATED APPLICATIONS

This application claims priority to U.S. patent application No. 62/237,724 filed Oct. 6, 2015.

BACKGROUND OF THE INVENTION

1. Field of the Invention

The present invention relates generally to door closers or operators that utilize a compression spring to apply force to close a door. More specifically, the present invention relates to a spring adjuster and indicator for use with a door closer or operator, which allows for adjustment of the spring closing force while the door closer housing remains stationary, while also providing a visual indicator of the level of spring compression.

2. Description of Related Art

Some conventional window or door closers or operators utilize a compression spring to apply force to close the door or window. As utilized herein, the term "door" also includes a window that is similarly operated, e.g., by pivoting movement on a pivot or hinge. An embodiment of a typical prior art door closer 120 is shown in FIG. 1 and includes a closer housing 122 that in part defines a substantially cylindrical reservoir, a piston 126 and compression spring 130 biased against the piston 126. A rack 138 is attached to the piston 126. The rack 138 is driven by a pinion 140 through engagement with the teeth 142 of the pinion 140. The pinion 140 is connected to a closer arm assembly (not shown) for operably coupling the door closer 120 to a door. FIG. 1 shows the door closer 120 in a position corresponding to a closed door. As the door is opened, the pinion 140 rotates in an initial direction, transporting the rack 138 and consequently sliding the piston 126 to the right as shown in FIG. 1. The compression spring 130 urges the piston 126 and rack 138 to the left in FIG. 1. When the force of the compression spring 130 overcomes the input force from the door and pinion 140 such as when the door is released, the compression spring 130 will force the piston 126 to the left in FIG. 1, and the pinion 140 will rotate in a direction opposite the initial direction and the door closer 120 will act to close the door.

The spring in a door closer or operator indirectly applies force to the door in the closing direction. The amount of spring force or tension is determined by the geometry of the spring and the amount of preload applied by compressing the spring from its static length. Presently, adjusting the spring setting in closers is often done with an adjusting screw using a tool to turn the adjusting screw. U.S. Pat. No. 8,732,905 discloses an example of a door or window closer using an adjusting screw that has an external end that is turned by a nut, knob or socket.

Determining the spring force setting of a closer or operator on a door is typically done by counting the number of turns on a spring adjust screw on the closer. However, there is no indication of the current spring preload prior to adjustment or after past adjustments, unless documented. It must then be checked by measuring the force on the door. A need exists for a means for an installer to be able to visually determine where the spring force is set while installing the closer.

SUMMARY OF THE INVENTION

Bearing in mind the problems and deficiencies of the prior art, it is therefore an object of the present invention to provide a door closer or operator that allows for adjustment of the spring closing force while the door closer housing remains stationary.

It is another object of the present invention to provide a door closer or operator comprising a spring collar bearing on a compression spring during adjustment of the spring preload and slidable linearly within the door closer housing while being non-rotatable about a longitudinal axis of the housing, the spring being compressible to different positions to vary force applied by the door operator or closer.

A further object of the invention is to provide a door closer or operator which provides a visual means of viewing the actual direct position and setting of the spring in a door operator or closer.

Still other objects and advantages of the invention will in part be obvious and will in part be apparent from the specification.

The above and other objects, which will be apparent to those skilled in the art, are achieved in the present invention which is directed to an apparatus for adjusting the force in a door operator or closer for closing a door. The apparatus comprises a housing having a longitudinal axis, a spring within the housing and connected to the door operator or closer, the spring being compressible to different positions to vary force applied by the door operator or closer, and a spring collar non-rotatable about the longitudinal axis of the housing and adapted to move linearly within the housing, the spring collar bearing on the spring to vary the spring compression and thereby vary force applied by the door operator or closer. The spring collar may bear against an end of the spring distal from the door operator or closer.

The spring collar and housing may have complementary-shaped non-circular cross-sections to prohibit rotation of the spring collar about the longitudinal axis of the housing, while permitting linear movement of the spring collar within the housing. In one embodiment, the spring collar may comprise a plurality of spaced protrusions about its perimeter and an interior surface of the housing may comprise a plurality of spaced depressions which mate with the spring collar protrusions.

In an embodiment, the housing may be a tube coaxially disposed about the longitudinal axis. The housing may include a sidewall having a slot extending along at least a portion of its length and the spring collar may include a tab received within and slidable in the housing slot, wherein the tab prevents rotation of the spring collar about the longitudinal axis of the housing. The spring collar tab may be at least partially visible from the exterior of the housing through the sidewall slot to indicate compression of the spring.

In another embodiment, the housing may include a sidewall having an opening, wherein a position of the spring and at least a portion of the spring collar is viewable from the exterior of the housing through the sidewall opening. The apparatus may further include one or more markings on the housing indicating the degree of spring compression, and may include an indicator moveable along and visible outside the housing to indicate the compression of the spring.

In at least one embodiment, the apparatus may further include an adjusting screw extending along the longitudinal axis of the housing, and a nut threadably engaged at an end of the adjusting screw distal from the door operator or closer and rotatable about the longitudinal axis. During rotation, the nut bears against the spring collar to compress the spring to different positions to vary force applied by the door operator or closer. The housing may be adapted to prohibit rotation of the adjusting screw upon rotation of the nut.

The spring may be a coil spring and the adjusting screw may extend through the coil spring. In an embodiment, the adjusting screw may pass through the spring collar, and the spring collar may be slidable along an outer surface of the adjusting screw. The outer surface of the adjusting screw may comprise opposing flat sections and the spring collar may comprise an opening having flat interior sides for mating with the adjusting screw flat sections. The spring collar prevents rotation of the adjusting screw about the longitudinal axis of the housing.

The apparatus may further include an end cap at a distal end of the housing, the end cap comprising an opening permitting access for rotation of the nut.

In another aspect, the present invention is directed to a method of adjusting the force in a door operator or closer for closing a door. The method comprises providing a housing having a longitudinal axis, a spring within the housing and connected to the door operator or closer, and a spring collar non-rotatable about the longitudinal axis of the housing and adapted to move linearly within the housing, the spring collar bearing on the spring. The method further comprises moving the spring collar linearly along the longitudinal axis of the housing to vary compression of the spring, thereby varying force applied by the door operator or closer to close the door.

The housing may include a sidewall having an opening, wherein a position of the spring is viewable from the exterior of the housing through the sidewall opening, and the method may further include viewing the position of the spring from the exterior of the housing through the sidewall opening. In another embodiment, the housing may include a sidewall having a slot extending along at least a portion of a length thereof and the spring collar may include a tab received within and slidable in the housing slot. The tab may be at least partially visible from the exterior of the housing through the sidewall opening to indicate compression of the spring, and the method may further include viewing the position of the spring collar tab from the exterior of the housing through the sidewall opening to determine the position of the spring and the force applied by the spring to the door operator or closer.

In at least one embodiment, the method may further include providing an adjusting screw extending along a longitudinal axis of the housing, and a nut threadably engaged at an end of the adjusting screw distal from the door operator or closer and rotatable about the longitudinal axis, the nut bearing on the spring collar during rotation. The step of moving the spring collar linearly along the longitudinal axis of the housing may then comprise rotating the nut about a longitudinal axis of the adjusting screw. The nut may be rotated clockwise or counterclockwise to increase or decrease the spring compression and the force applied by the door operator or closer.

The adjusting screw may pass through the spring collar and the spring collar may be slidable along an outer surface of the adjusting screw. As such, the step of moving the spring collar linearly along the longitudinal axis of the housing may comprise rotating the nut about the longitudinal axis of the adjusting screw to cause the spring collar to slide along the outer surface of the adjusting screw to a desired position to apply the desired force to the door operator or closer. The method may further include the step of preventing rotation of the adjustment screw about the longitudinal axis of the housing during rotation of the nut.

In at least one embodiment, the housing may include an end cap at a distal end of the housing comprising an opening permitting access for rotation of the nut, wherein the step of moving the spring collar linearly along the longitudinal axis of the housing comprises accessing the nut through the end cap opening and rotating the nut about the longitudinal axis of the adjusting screw while the housing remains stationary.

In still another aspect, the present invention is directed to an apparatus for adjusting the force in a door operator or closer for closing a door, comprising a housing having a longitudinal axis, a spring within the housing and connected to the door operator or closer, the spring being compressible to different positions to vary force applied by the door operator or closer, a spring collar adapted to move linearly within the housing, the spring collar bearing on the spring to vary the spring compression and thereby vary force applied by the door operator or closer, an adjusting screw extending along the longitudinal axis of the housing, and a nut threadably engaged at an end of the adjusting screw distal from the door operator or closer and rotatable about the longitudinal axis, the nut bearing on the spring collar during rotation, wherein the housing, spring collar and adjusting screw are restricted from relative rotational movement.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 4 is an exploded view of an embodiment of the spring adjuster of the present invention, including the adjustment screw, spring collar, nut and washers. The spring into which the adjustment screw is inserted and the spring collar bears is not shown (for clarity).

FIG. 5 is a partially exploded view of the end portion of the housing and spring adjuster of FIG. 3, showing the internal details of the spring, spring collar, adjustment screw, and spring adjustment indicator.

DESCRIPTION OF THE EMBODIMENT(S)

In describing the embodiments of the present invention, reference will be made herein to FIGS. 1-8 of the drawings in which like numerals refer to like features of the invention.

Figure 1:
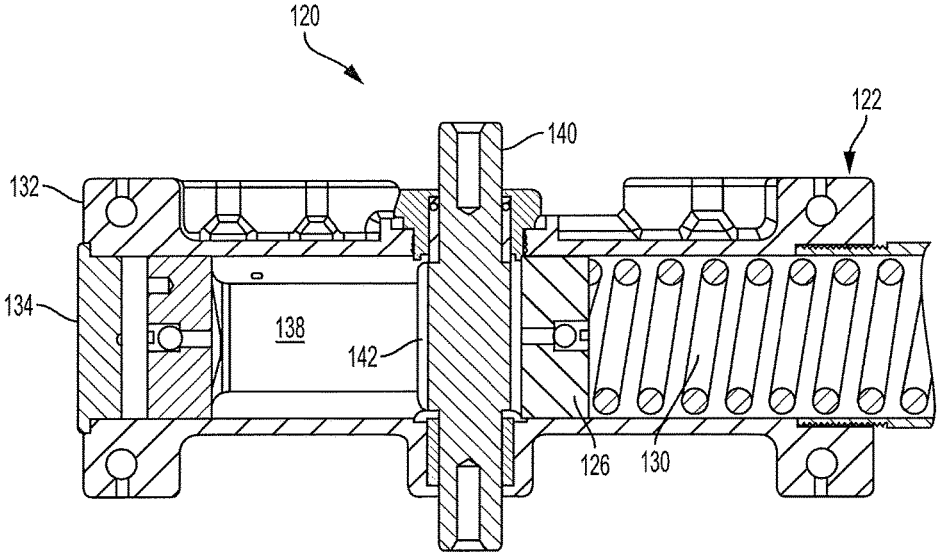
FIG. 1 PRIOR ART
FIG. 1 is a side cross-sectional view of a prior art door closer.
Figure 2:
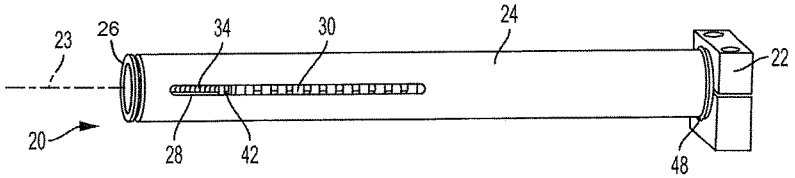
FIG. 2 is a perspective view of an embodiment of a spring adjuster and indicator made in accordance with the present invention, mounted on a door operator or closer.

An embodiment of a door closer or operator including embodiments of the spring adjuster and indicator of the present invention are shown in FIGS. 2-8, inclusive. The spring adjuster and indicator 20 of the present invention can be used on any otherwise conventional door closer or operator that uses a linearly adjustable spring for applying the desired degree of force for closing the door, such as the door closer 120 of FIG. 1. The spring in the door operator/closer indirectly applies force to the door in the closing direction. As shown in FIG. 2, door closer or operator 22 is affixed to a door or a frame for the door (not shown), and has a dampening mechanism (not shown) that resists the force of the spring and controls the speed at which the door closes. The closer spring is pre-loaded so that it applies force on the dampening mechanism and door even when the door is closed, which degree of pre-stress must be overcome when the door is initially opened. The amount of spring force is determined by the geometry of the spring and its degree of compression, i.e., the amount of preload applied by compressing the spring from its static length.

Figure 3:
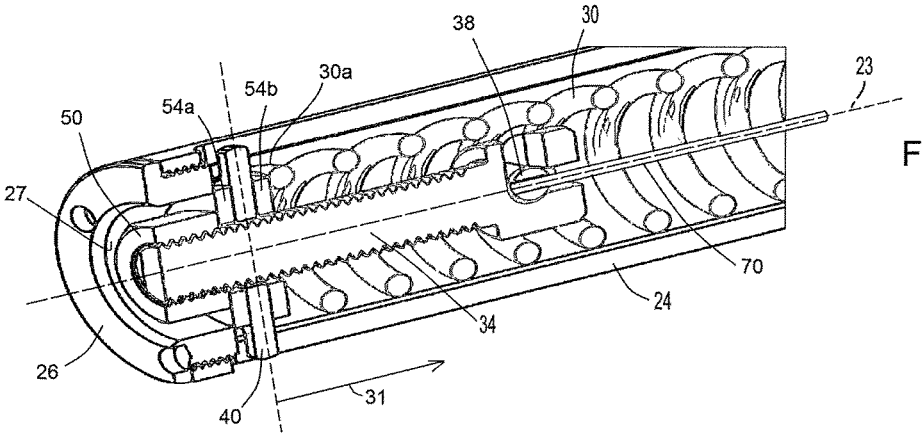
FIG. 3 is a cross-sectional perspective view of an end portion of a door closer housing including an embodiment of the spring adjuster of the present invention.

As further shown in FIG. 2, spring adjuster and indicator 20 includes a housing 24 in the form of an elongated tube and, inside, a compression coil spring 30 which applies the door-closing force to door operator/closer 22 at proximal end 48. As shown in FIGS. 2-3, in an embodiment, one spring 30 is used, however it should be understood by those skilled in the art that more than one spring may be utilized, such as a smaller diameter coil spring inside of spring 30. Housing tube 24 is rigidly secured within door operator/closer 22 at proximal end 48 to the fixed door operator or closer to prevent rotation of the housing about longitudinal axis 23. An end cap 26 closes the distal end of tube 24, and includes an opening 27 permitting access for rotation of a nut threaded onto an adjustment screw for adjusting the force of the spring, while the housing remains stationary, as will be discussed in more detail below. Along and inside the longitudinal axis 23 of the tube and spring may be an adjustment screw 34 threaded along all or a portion of its length (FIGS. 3-4). As shown in FIG. 3, in an embodiment, a rod 70 may be engagable with the head 38 of the adjustment screw 34 and the rod may be affixed at the proximal end 48 of the housing 24 so that the adjustment screw is stabilized along the central axis 23 and is prevented from moving in an axial direction. A spring collar 40 is slidable along longitudinal axis 23 so that the adjustment screw passes through the spring collar, and bears against the distal end 30*a* of spring 30 (FIGS. 3-5). The tube 24, collar 40 and adjustment screw 34 are restricted from relative rotational movement.

As further shown in FIG. 3, in one embodiment, the spring adjuster 20 of the present invention includes a nut 50 threaded on the adjustment screw 34. The force on the spring 30 is adjusted by rotating the nut 50 by hand or by tool, such as with a socket. Nut 50 bears against spring collar 40 such that rotating the nut 50 serves to move the spring collar 40 longitudinally in the direction of arrow 31 to adjust the degree of compression and therefore the preload of the spring 30. Spring collar 40 lacks internal threads and is adapted to slide on the adjustment screw 34 for preload on the spring when tightening, but hold the adjustment screw 34 rigid about the longitudinal axis 23, preventing rotation. In an embodiment, a Double-D shape spring collar as shown may be used, wherein the straight internal sides 44*a*, 44*b* of the collar opening are adapted to slide along flat sections 36 on either side of the adjusting screw 34 (FIG. 4). As further shown in FIGS. 3-4, in at least one embodiment, washers 54*a*, 54*b* may be used on either side of the collar 40 so that a plastic collar part may be used, however it should be understood by those skilled in the art that in other embodiments, spring collar 40 could also be made as one single, unitary part.

As nut 50 is rotated about the longitudinal axis of adjustment screw 34 and spring collar 40 moves linearly toward or away from operator/closer 22, it causes spring 30 to increase or decrease the degree of compression of the spring length, respectively. The selected degree of compression of the spring operates to vary the force applied by the door operator or closer, with a shorter extension (i.e., greater compression) applying more force, and a longer extension (i.e., less compression) applying less force.

In at least one embodiment, spring collar 40 may include a tab 42 extending radially outward from the collar, which collar tab is received within and slidable in a slot or window 28 extending along a length of and through the side wall of tube 24 (FIGS. 2, 4 and 5). The tab/slot interface is designed to permit the spring collar 40 to move longitudinally to adjust the degree of compression and therefore the preload of the spring 30, while preventing rotation of the spring collar about the tube longitudinal axis 23. It should be understood by those skilled in the art that the Double-D shape spring collar 40 with tab 42 shown herein is only one such means for achieving the desired longitudinal (and not rotational) movement, and that other known methods are contemplated by the present invention, such as shaping the collar 40 and housing tube 24 with matching cross-sections and clearances, as shown in FIGS. 6 and 7.

Figure 8:
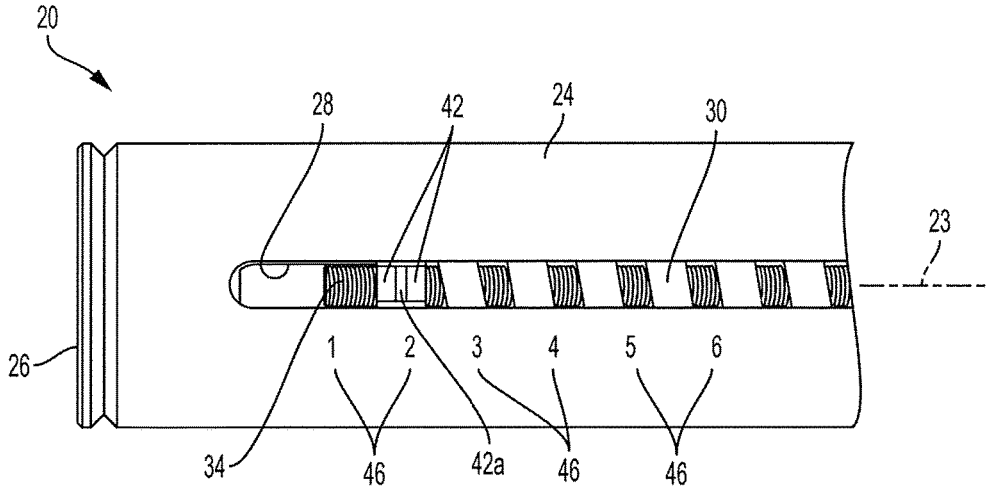
FIG. 8 is a side elevational view of the end portion of the spring adjuster and indicator of FIG. 2 showing the spring adjustment indicator and indicia.

The spring 30, spring collar 40, spring collar tab 42 and position of the spring and spring collar linearly along axis 23 may be visible through slot opening 28 in housing 24 (FIGS. 2, 5, 6 and 8). A layer of transparent or translucent glass or plastic may be fitted over the slot. The length of the slot 28 in tube 24 may be selected to be substantially the length of travel available for spring collar 40. As shown in FIG. 8, spring collar tab 42 may have a mark 42*a* thereon, which is indexable along markings or indicia 46, for example numerals 1-6, adjacent the slot and extending along the length of the tube exterior. The position of tab mark 42*a* with respect to markings 46 indicate the spring setting of the closer and the preload of the spring on the closer 22.

Figure 6:
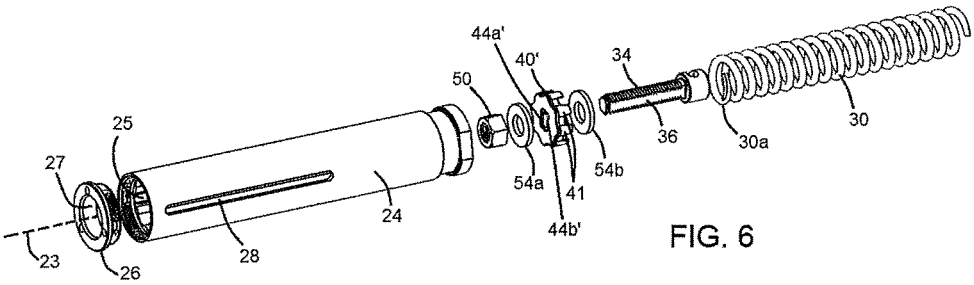
FIG. 6 is an exploded view of another embodiment of the spring adjuster and housing of the present invention, showing a spring collar and housing having complementary non-circular cross-sections and clearances to prevent rotation of the spring collar about the longitudinal axis of the housing while permitting linear movement of the spring collar within the housing.
Figure 7:
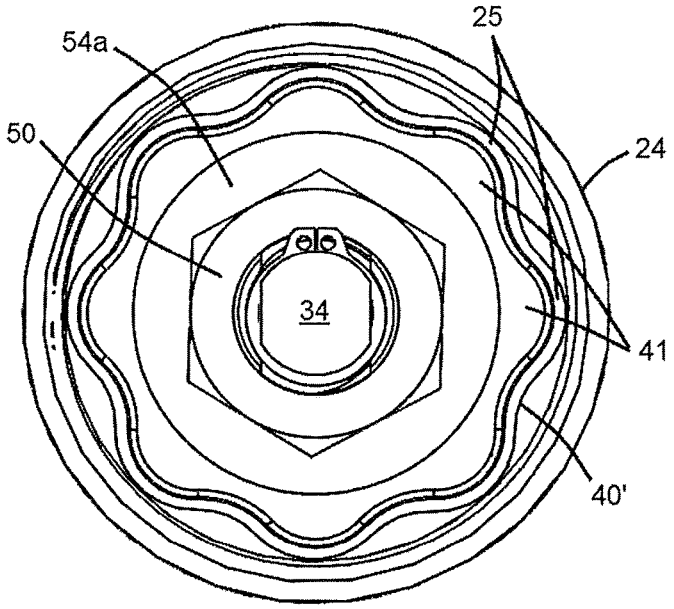
FIG. 7 is a cross-sectional view of the spring adjuster and housing of FIG. 6, showing the complementary cross-sections and clearances of the spring collar and housing.

FIGS. 6 and 7 depict another embodiment of the spring adjuster and housing of the present invention, wherein the spring collar and housing have matching cross-sections and clearances to prevent rotation of the spring collar about the longitudinal axis of the housing. As shown in FIG. 6, spring collar 40' has a non-circular profile comprising a plurality of spaced protrustions 41 about its perimeter. As further shown in FIG. 6, and best seen in FIG. 7, housing 24 has a complementary non-circular cross-section comprising a plurality of depressions 25 which mate with the protrusions 41 of collar 40', forming a series of alternating protrusions and depressions which prohibit rotation of collar 40' about the longitudinal axis 23 of housing 24, but permit linear movement of collar 40' within the housing, during rotation of nut 50 to adjust the spring force.

Adjustment screw 34 extends through spring collar 40' and collar 40' is adapted to slide along the length of the adjustment screw 34 for preload on the spring when tightening, but hold the adjustment screw 34 rigid about the longitudinal axis 23, preventing rotation. Spring collar 40' has an opening comprising straight internal sides 44*a*', 44*b*' which are adapted to slide along flat sections 36 on either side of the adjusting screw 34 (FIG. 6). The position of spring 30 and spring collar 40' linearly along axis 23 may be visible through slot opening 28 in housing 24 to indicate the spring setting of the closer and the preload of the spring on the closer. It should be understood by those skilled in the art that other non-circular complementary cross-sections may also be used to prohibit rotation of the spring collar about the longitudinal axis of the housing, while permitting linear movement of the spring collar within the housing, and that the present invention is not limited to the shapes shown in FIGS. 6-7.

In operation, an installer rotates nut 50 about the longitudinal axis of adjustment screw 34 by hand or by using a tool such as a socket, in a clockwise or counterclockwise direction, which causes spring collar 40 or 40' to slidably move along the length of screw 34 and tab 42 to slide linearly along the length of slot 28 within stationary housing 24. As the spring collar moves linearly along axis 23, the spring either compresses or relaxes, thus changing the preload of the spring to increase or decrease the force on the door operator/closer. The compression of the spring can be seen through the window 28 in the tube and provides a visual indicator of the closer setting, based on spring force. The position of the spring collar, which may be converted to and indicates the amount of force applied by spring 30, is indicated by the position of tab mark 42*a* and indicia 46 marked on the tube. This enables the user or installer to easily see the setting to which the door operator/closer is adjusted or set. Moreover, the compression of the spring may easily be re-adjusted after installation by way of the opening 27 in end cap 26 which permits access for rotation of the nut 50 by hand or by tool, without removing the closer housing 24.

Significantly, the adjusting screw of the present invention does not turn during adjustment of the spring tension and, instead, the spring tension is adjusted by rotating a nut clockwise or counterclockwise which causes the spring collar to slidably move along the length of the adjustment screw to increase or decrease the spring force. The spring collar is non-rotatable about the longitudinal axis of the housing, and may be fixed in the slot of the tube, therefore as the nut is rotated, the spring collar moves linearly in the slot while the adjusting screw does not rotate, thus changing the preload of the spring. The compression of the spring may be seen through a slot or window extending along the length of the spring tube.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for adjusting the force in a door operator or closer for closing a door, comprising:

a housing having a longitudinal axis;

a spring within the housing and connected to the door operator or closer, the spring being compressible to different positions to vary force applied by the door operator or closer;

a spring collar non-rotatable about the longitudinal axis of the housing and slideable linearly within the housing, the spring collar bearing on the spring to vary the spring compression and thereby vary force applied by the door operator or closer;

an adjusting screw extending along the longitudinal axis of the housing and passing through the spring collar; and a nut threadably engaged at an end of the adjusting screw distal from the door operator or closer and rotatable about the longitudinal axis, the nut bearing on the spring collar during rotation, wherein the spring collar prevents rotation of the adjusting screw about the longitudinal axis of the housing.

2. The apparatus of claim 1 wherein the housing is a tube coaxially disposed about the longitudinal axis.

3. The apparatus of claim 1 wherein the spring has an end distal from the door operator or closer, and the spring collar bears against the spring end.

4. The apparatus of claim 1 wherein the adjusting screw does not turn upon rotation of the nut.

5. The apparatus of claim 1 further including an end cap at a distal end of the housing, the end cap comprising an opening permitting access for rotation of the nut.

6. The apparatus of claim 1 wherein the spring is a coil spring and the adjusting screw extends through the coil spring.

7. The apparatus of claim 1 wherein the spring collar is slidable linearly along an outer surface of the adjusting screw.

8. The apparatus of claim 7 wherein the outer surface of the adjusting screw comprises opposing flat sections and the spring collar comprises an opening having flat interior sides for mating with the adjusting screw flat sections.

9. The apparatus of claim 1 wherein the housing includes a sidewall having a slot extending along at least a portion of a length thereof and the spring collar includes a tab received within and slidable in the housing slot, the tab preventing rotation of the spring collar about the longitudinal axis of the housing.

10. The apparatus of claim 9 wherein the spring collar tab is at least partially visible from the exterior of the housing through the sidewall slot to indicate compression of the spring.

11. The apparatus of claim 1 wherein the housing includes a sidewall having an opening, and wherein a position of the spring and at least a portion of the spring collar is viewable from the exterior of the housing through the sidewall opening.

12. The apparatus of claim 11 further including one or more markings on the housing indicating the degree of spring compression.

13. The apparatus of claim 11 further including an indicator moveable along and visible outside the housing to indicate the compression of the spring.

14. The apparatus of claim 1 wherein the spring collar and housing have complementary-shaped non-circular cross-sections to prohibit rotation of the spring collar about the longitudinal axis of the housing while permitting linear movement of the spring collar within the housing.

15. The apparatus of claim 14 wherein the spring collar comprises a plurality of spaced protrusions about its perimeter and an interior surface of the housing comprises a plurality of spaced depressions which mate with the spring collar protrusions.

16. A method of adjusting the force in a door operator or closer for closing a door comprising:

providing a housing having a longitudinal axis; a spring within the housing and connected to the door operator or closer; and a spring collar non-rotatable about the longitudinal axis of the housing and slideable linearly within the housing, the spring collar bearing on the spring and being adjustable by sliding the spring collar linearly along the longitudinal axis of the housing; an adjusting screw extending along a longitudinal axis of the housing and passing through the spring collar; and a nut threadably enagaged at an end of the adujusting screw distal from the door operator or closer and rotatable about the longitudinal axis, the nut bearing on the spring collar during rotation; and sliding the spring collar linearly along the longitudinal axis of the housing to vary compression of the spring by rotating the nut about a longitudinal axis of the adjusting screw, thereby varying force applied by the door operator or closer to close the door, wherein the spring collar prevents rotation of the adjusting screw about the longitudinal axis of the housing.

17. The method of claim 16 wherein the nut is rotated clockwise or counterclockwise to increase or decrease the spring compression and the force applied by the door operator or closer.

18. The method of claim 16 wherein the housing includes a sidewall having an opening, a position of the spring being viewable from the exterior of the housing through the sidewall opening, and further including:

viewing the position of the spring from the exterior of the housing through the sidewall opening.

19. The method of claim 16 wherein the housing includes a sidewall having a slot extending along at least a portion of a length thereof and the spring collar includes a tab received within and slidable in the housing slot, the tab being at least partially visible from the exterior of the housing through the sidewall opening to indicate compression of the spring, and further including:

viewing the position of the spring collar tab from the exterior of the housing through the sidewall opening to determine the position of the spring and the force applied by the spring to the door operator or closer.

20. The method of claim 16 wherein the spring collar is slidable along an outer surface of the adjusting screw, and wherein the step of moving the spring collar linearly along the longitudinal axis of the housing comprises:

rotating the nut about the longitudinal axis of the adjusting screw to cause the spring collar to slide along the outer surface of the adjusting screw to a desired position to apply the desired force to the door operator or closer.

21. The method of claim 16 wherein the housing includes an end cap at a distal end of the housing comprising an opening permitting access for rotation of the nut, and wherein the step of moving the spring collar linearly along the longitudinal axis of the housing comprises accessing the nut through the end cap opening and rotating the nut about the longitudinal axis of the adjusting screw while the housing remains stationary.

* * * * *